United States Patent [19]

Watts

[11] Patent Number: 4,534,402

[45] Date of Patent: Aug. 13, 1985

[54] METHOD OF CASTING PIN TUMBLER LOCK BARRELS

[76] Inventor: John R. Watts, 116 North Rd., Brighton, Vic. 3186, Australia

[21] Appl. No.: 478,273

[22] Filed: Mar. 24, 1983

[30] Foreign Application Priority Data

Mar. 29, 1982 [AU] Australia ..... PF3367
Jul. 6, 1982 [AU] Australia ..... PF4713

[51] Int. Cl.[3] ..... B22D 13/00; B22D 33/04

[52] U.S. Cl. ..... 164/302; 164/303; 164/312; 164/340

[58] Field of Search ..... 164/302, 303, 312, 340–342, 164/137, 339

[56] References Cited

U.S. PATENT DOCUMENTS 3,381,745 5/1968 Spain ..... 164/303

*Primary Examiner*—Nicholas P. Godici
*Assistant Examiner*—Richard K. Seidel
*Attorney, Agent, or Firm*—Scully, Scott, Murphy & Presser

[57] ABSTRACT

Apparatus for diecasting the barrel for a pin tumbler lock without the need for subsequent machining. The die comprises a generally barrel shaped cavity and three retractable cores. The first core extends radially inwardly into the cavity from one end to form the entry hole for the key and the second and third cores extend radially into the cavity until they meet at a line about which is formed a fin adapted to mate with a channel in the key. The third core also defines guide channels for the pin tumblers.

6 Claims, 9 Drawing Figures

FIG. 3.
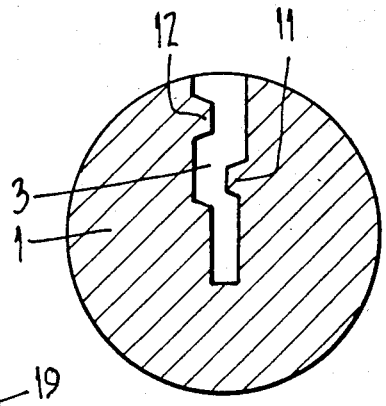
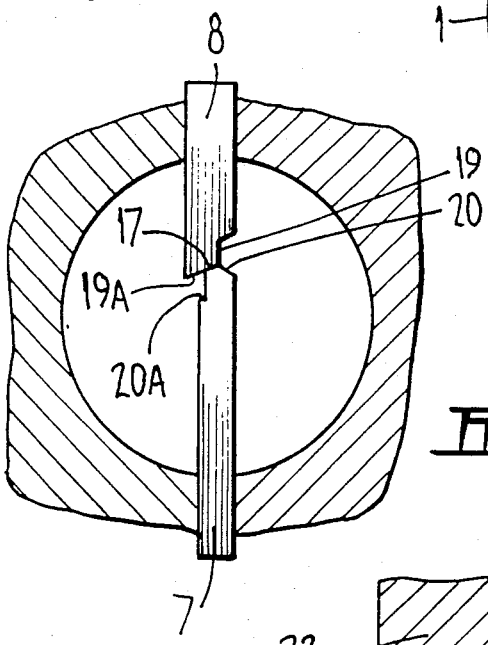
FIG. 8.
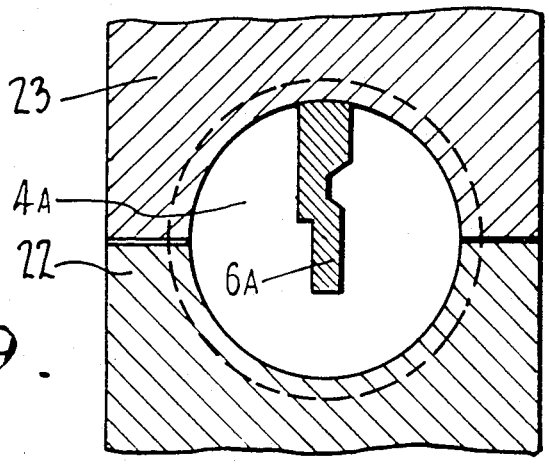
FIG. 9.

METHOD OF CASTING PIN TUMBLER LOCK BARRELS

BACKGROUND OF THE INVENTION

This invention relates to a pin tumbler lock and has been devised particularly though not solely to allow the barrel of the lock to be diecast in a single operation without the necessity for further machining.

In the past the barrels for pin tumbler locks have been manufactured by machining the barrel from a brass blank by turning and broaching drilling the guide channels for the pins and turning a circlip groove. The barrel is machined by broaching to form an axial channel having a plurality of axial grooves adapted to receive the key into the barrel of the lock. The axial channel formed by machining intersects with the guide channels drilled for the radially slidable locking pins so that the teeth of the key can move the pins through the desired length to free the barrel for rotation within the cylinder of the lock. This fully machined method of manufacture is relatively expensive, it requires the use of several items of expensive machinery and more importantly it requires the careful setting and maintenance of many metal removing tools. From a manufacturing and product reliability point of view the method is relatively poor.

In a few instances pin tumbler barrels have been partly cast by casting the general barrel shape with the guide channels partly cast and in particular cast in the portion which does not intersect the longitudinal key slot.

The key slot would be cast by employing a longitudinal core which would project the length of the key way, but using this method the pin channels still need to be drilled and the long key way core is susceptable to damage and other casting problems.

SUMMARY OF THE INVENTION

It is therefore an object of the present invention to provide apparatus for diecasting a barrel for a pin tumbler lock which will obviate or minimize the foregoing disadvantages in a simple yet effective manner or which will at least provide the public with a useful choice.

It is a further object of the invention to provide apparatus for diecasting a barrel for a pin tumbler lock which will enable the complete barrel to be cast in one operation without requiring further machining.

It is a further object of the present invention to provide a barrel for a pin tumbler lock of a specific design so that the barrel can be manufactured in a single diecasting operation.

Accordingly in one aspect the invention consists in apparatus for diecasting a barrel for a pin tumbler lock, said apparatus comprising a die having a generally barrel shaped cavity incorporating at least three retractable cores, therebeing a first core retractable axially with respect to the centre-line of the barrel and defining the entry hole and guide channel for a key, said first core in the extending position extending into the barrel no further than the guide channel for the first pin, and second and third cores retractable radially with respect to the centre-line of the barrel, positioned substantially diametrically opposite one another and extending into the barrel so as to meet one another and also said first core when all three cores are fully extended during casting, said second core comprising a central web and a plurality of pairs of opposed protrusions on either side thereof, each pair of opposed protrusions defining a guide channel for a pin, and said third core in conjunction with said second core defining an axial inwardly projecting fin adapted to mate with a channel in a key, one side of said fin being defined by said second core and the other side by said third core.

BRIEF DESCRIPTION OF THE DRAWINGS

Notwithstanding any other forms that may fall within its scope one preferred form of the invention will now be described by way of example only with reference to the accompanying drawings in which:

FIG. 3 is a cross-sectional view on the line III—III of FIG. 2, FIG. 8 is a cross-sectional view of the die and extended cores used to form section V—V in an alternative form of the invention wherein the guide channel is provided with two fins, and FIG. 9 is a cross-sectional view of the die and extended cores used to form section IX—IX as shown in FIG. 2.

DETAILED DESCRIPTION OF THE INVENTION

In the preferred form of the invention a barrel for a pin tumbler lock is diecast in a single operation as follows.

Figure 1:
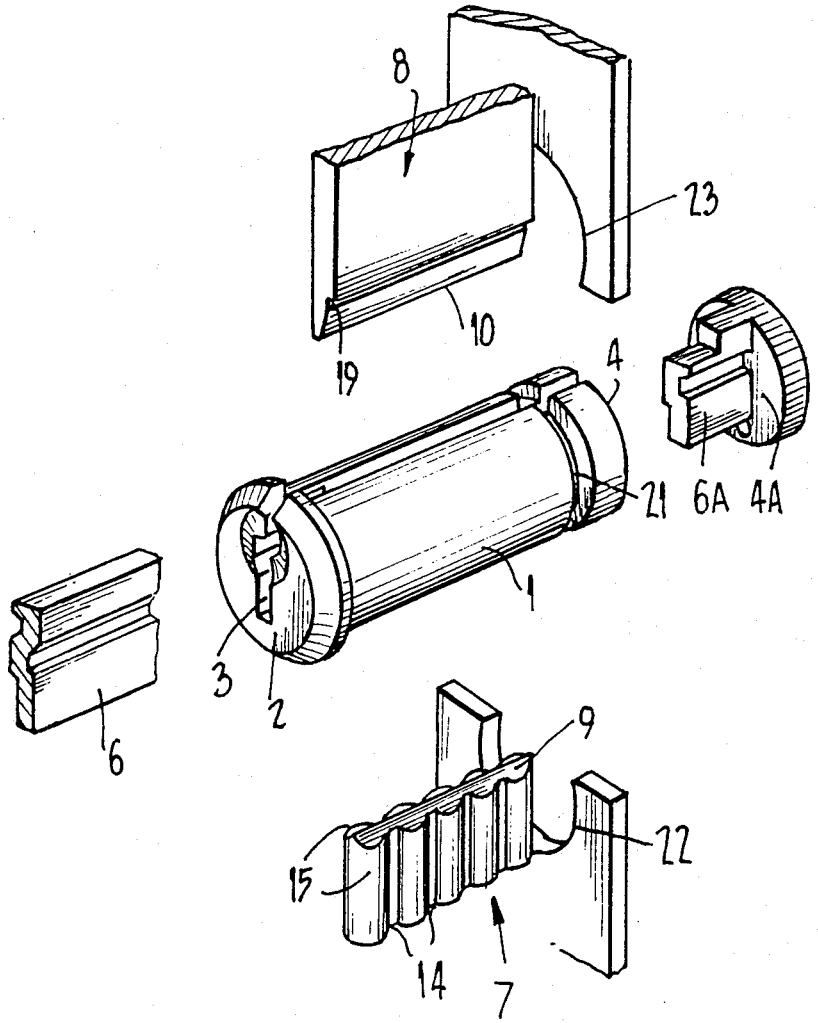
FIG. 1 is a perspective view of a barrel for a pin tumbler lock according to the invention showing diagrammatically the retractable die cores used in the casting of the barrel.
Figure 2:
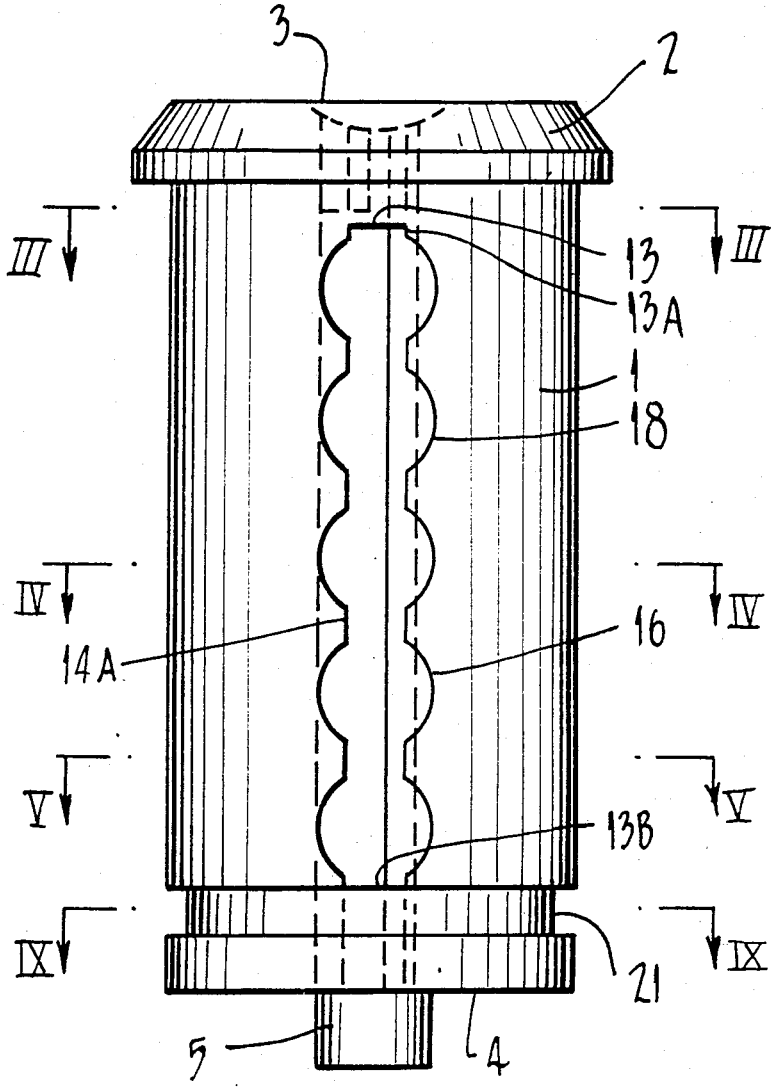
FIG. 2 is an underside view of the barrel shown in FIG. 1.
Figure 4:
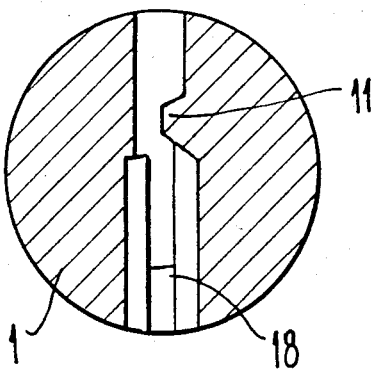
FIG. 4 is a cross-sectional view on the line IV—IV of FIG. 2.

The barrel is cast in a normal die cavity to the general configuration shown at 1 in FIG. 1 being of generally cylindrical barrel configuration having a front face 2 incorporating an aperture 3 adapted to receive a key (not shown) and a rear face 4 incorporating some type of drive means such as a spigot 5 (FIG. 2) to operate the lock mechanism. The die incorporates three retractable cores, therebeing a first core 6 retractable axially with respect to the centre-line of the barrel, a second core 7 and a third core 8 positioned diametrically opposite one another and extending radially into the barrel 1 so that the leading edges 9 and 10 respectively meet within the die cavity defining the barrel when the cores 7 and 8 are fully extended. The second and third cores also meet the first core 6 within the die cavity. The die is also provided with a fixed core 6A protruding axially into the die cavity from the rear die wall 4A.

The first core 6 is formed to a cross-sectional shape corresponding to the general cross-section of the key blank and which can be seen clearly with reference to FIG. 3. This shape forms a restricted entry aperture for a key, the aperture typically having first and second axial fins 11 and 12 to accommodate the grooves which are normally provided in the cross-section of the key.

Although the preferred embodiment has been shown as incorporating two such grooves on opposite sides of the key it will be appreciated that the cross-sectional shape may be varied for example to incorporate only one fin 11 for a single groove or alternatively to incorporate three or more fins which may align with grooves on the same side of the key or on different sides of the key as appropriate to the particular situation. The first core 6 is of such a length that it extends inwardly into the barrel from the end 2 to point 13 this being no further than point 13A (FIG. 2) which is the edge of the guide channel for the first tumbler pin.

The second core 7 comprises a central web 14 and a plurality of pairs of opposed protrustions 15 on either side of the web, each pair of opposed protrusions defining a guide channel for a pin. In the preferred form of the invention the opposed protrustions form portions of cylinders as can be clearly seen from the shape of the slot 16 formed by the core in the underside of the barrel (FIG. 2) and the web 14 forms a connecting slot 14A. In other forms of the invention however the pins to be used in the lock may be rectangular in configuration or hexagonal or any other desired shape and the protrusions 15 may therefore be shaped accordingly. The second core extends longitudinally in the die cavity from point 13 to point 13B (FIG. 2) which in the preferred form of the invention is tangential to the last guide channel for a pin. At point 13B the second core may be provided with an extension 22 (FIGS. 1 and 9) which defines one half of the circlip groove 21 (FIG. 2) on the outer periphery of the barrel.

Figure 6:
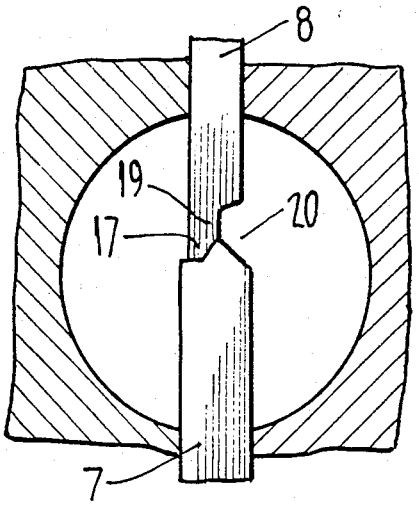
FIG. 6 is a cross-sectional view of the die and extended cores used to form section IV—IV as shown in FIG. 4.
Figure 5:
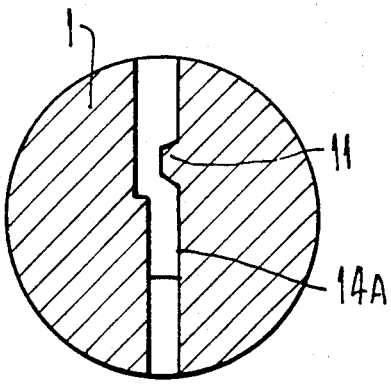
FIG. 5 is a cross-sectional view on the line V—V of FIG. 2.
Figure 7:
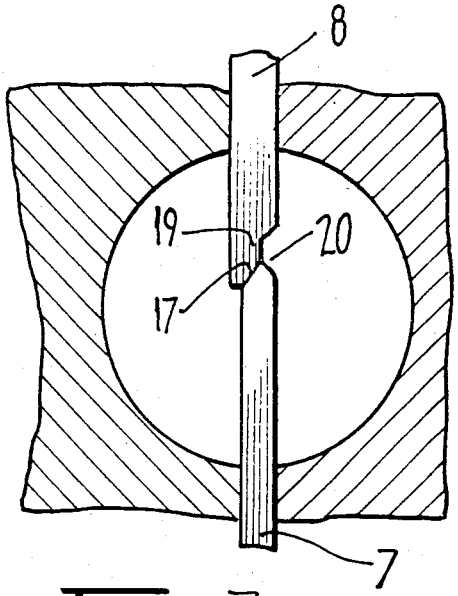
FIG. 7 is a cross-sectional view of the die and extended cores used to form section V—V as shown in FIG. 5.

The third core 8 comprisies a substantially parallel sided core formed to a particular cross-section most clearly seen in FIGS. 6 and 7 defining part of the axial guide channel for the key. In alternative forms of the invention the third core may decrease in thickness (e.g. stepwise) toward the centre of the die. The third core extends longitudinally in the die cavity over the same length as the second core, and may similarly be provided with an extension 23 (FIGS. 1 and 9) defining the other half of the circlip groove 21 on the outer periphery of the barrel.

The leading edges 9 and 10 of the second and third cores respectively are shaped so as to meet and coact on a join line 17 (FIGS. 6 and 7) so that the second and third cores in conjunction with one another define the fin 11 which mates with the guide channel in the key. The fin 11 is produced between points 2 and 13 by the first core 6 and between points 13 and 13B by the interaction of the second core 7 and the third core 8. The guide channels for the pins are of course formed as shown at 18 in FIG. 2 by the opposed pairs of protrusions 15 on the second core 7.

The leading edge 10 of the third core 8 is shaped to incorporate a recessed shoulder 19 (FIGS. 6 and 7) and similarly the leading edge 9 of the second core 7 incorporates an opposed recesses shoulder 20 so that when the second and third cores meet on the join line 17 the recessed shoulders define the axial fin 11. In this manner an axial fin adapted to mate with a groove in the key is formed in the axial key channel while yet allowing the second and third cores to be retracted radially during the casting operation. It is also possible to form a second fin (for an axial groove on the other side of the key) as shown in FIG. 8. In this configuration a further shoulder 20A is formed on the core 7, defining a second fin between the shoulder 20A and the end 19A of the core 8. In this manner one or two fins can be provided while still allowing radial retraction of cores 7 and 8.

In use of the invention the cores 6 and 7 and 8 are advanced into the die cavity which is then filled with the casting material in the normal manner. The cores are then retracted and the die cavity opened so that the barrel formed to the shape shown and defined above may be ejected from the die cavity. It is a feature of the invention that the barrel so cast does not require any further machining, for example broaching to form the keyhole slot or turning to form the circlip groove, as is normally required for barrels of this type. Because of the web 14 between the pin hole cores in the second core 7 and because the axial fin 11 is formed at the joining line of the cores 7 and 8, the barrel may be used as cast without the necessity of any further machining.

It will be appreciated however that the methods described above may also be used in part simply to reduce the amount of machining needed in the manufacture of pin tumbler lock barrels and the barrels may be finished off by quick and simple machining operations.

In this manner a barrel for a pin tumbler lock may be cast in a single operation which is fast and economical and considerably reduces the cost of manufacturing the lock barrel. Because the first core 6 may be formed to any desired complex cross-sectional shape it is possible to utilize the invention to form barrels which may be with sophisticated keys having two or three or more axial grooves therein while yet retaining the single casting manufacturing process which is the feature of the invention.

What is claimed is:

1. Apparatus for diecasting a barrel for a pin tumbler lock, said apparatus comprising, a die having a generally barrel shaped cavity incorporating at least three retractable cores, a first core retractable axially with respect to the center-line of the barrel and defining the entry hole and guide channel for a key designed to operate a lock having the barrel as a component thereof, said first core in the extended position extending into the barrel no further than the guide channel for a first pin, a second core, and a third core, said second and third cores comprising the only cores which are retractable radially with respect to the center-line of the barrel and positioned substantially diametrically opposite one another and extending into the barrel so as to be placed in close proximity to one another and to said first core when all three cores are fully extended during casting, said second core comprising a central web and a plurality of pairs of opposed protrusions on either side thereof, each pair of opposed protrusions defining a guide channel for a pin, and said third core in conjunction with said second core defining an axial inwardly projection fin adapted to mate with a channel in the key, one side of said fin being defined by said second core and the other side by said third core.

2. Apparatus as claimed in claim 1, wherein each said opposed protrusion is semi-circular in configuration such that each pair of opposed protrusions defines a cylindrical guide channel for a pin.

3. Apparatus as claimed in claim 1, wherein each said opposed protrusion is rectangular in configuration such that each pair of opposed protrusions defines a rectangular guide channel for a pin.

4. Apparatus as claimed in claim 1, wherein said second and third cores are arranged to form said fin as a continuous fin between and across the guide channels for the pins.

5. Apparatus as claimed in claim 1, wherein said second and third cores are arranged to form said fin as a discrete number of segments having spaces therebetween in the region of said guide channels for the pins.

6. Apparatus as claimed in claim 1, wherein said second and third cores are provided with extensions arranged to define and form a circumferential circlip groove on the exterior of the barrel.

* * * * *